US010141135B1

(12) United States Patent
Yang et al.

(10) Patent No.: US 10,141,135 B1
(45) Date of Patent: Nov. 27, 2018

(54) KEYBOARD

(71) Applicant: Primax Eletronics Litd., Taipei (TW)

(72) Inventors: Che-Wei Yang, Taipei (TW); Tien-Yu Yeh, Taipei (TW); Ming-Han Wu, Taipei (TW)

(73) Assignee: PRIMAX ELECTRONICS LTD, Taipei (TW)

( * ) Notice: Subject to any disclaimer, the term of this patent is extended or adjusted under 35 U.S.C. 154(b) by 0 days.

(21) Appl. No.: 15/879,090

(22) Filed: Jan. 24, 2018

(30) Foreign Application Priority Data

Nov. 3, 2017 (TW) ..... 106138159 A

(51) Int. Cl.

| | |
|---|---|
| ***H01H 13/70*** | (2006.01) |
| ***H01H 13/7065*** | (2006.01) |
| ***H01H 3/12*** | (2006.01) |
| *H01H 13/705* | (2006.01) |

(52) U.S. Cl.
CPC ..... *H01H 13/7065* (2013.01); *H01H 3/122* (2013.01); *H01H 13/705* (2013.01); *H01H 2221/058* (2013.01)

(58) Field of Classification Search
CPC ..... H01H 3/125; H01H 13/705; H01H 13/83; H01H 13/14; H01H 13/85; H01H 13/7065
USPC ..... 200/5 A, 341–345
See application file for complete search history.

(56) References Cited

U.S. PATENT DOCUMENTS

| | | | | |
|---|---|---|---|---|
| 6,100,482 A * | 8/2000 | Koma | H01H 3/122 | 200/344 |
| 6,239,391 B1 * | 5/2001 | Nishijima | H01H 13/7006 | 200/302.2 |
| 7,265,310 B1 * | 9/2007 | Wang | H01H 3/122 | 200/344 |
| 8,410,385 B2 * | 4/2013 | Dai | H01H 23/02 | 200/296 |
| 2010/0025213 A1 * | 2/2010 | Li | H01H 3/125 | 200/344 |

* cited by examiner

*Primary Examiner* — Ahmed Saeed
(74) *Attorney, Agent, or Firm* — Kirton McConkie; Evan R. Witt

(57) ABSTRACT

The present invention relates to a keyboard, including: a key, a switch circuit board, and a base plate, and the key includes a keycap and a balance bar. The keycap includes a first hook and a second hook, and the first hook is disposed on an inner surface of the keycap and is located on an outer side of the keycap. The second hook is disposed on the inner surface of the keycap and is located in a central area of the keycap. The balance bar is disposed below the keycap and is fastened in a first opening of the first hook and a second opening of the second hook. The first opening has a round shape, and the second opening has an elliptic shape.

9 Claims, 6 Drawing Sheets

KEYBOARD

FIELD OF THE INVENTION

The present invention relates to an input device, and in particular, to a keyboard having a plurality of keys.

BACKGROUND OF THE INVENTION

A common computer peripheral input device includes a mouse, a keyboard, a trackball, and the like. The keyboard may be used to directly type words and symbols into a computer. Therefore, keyboards attract much attention of users and input device manufacturers. A subject matter of this application is a keyboard.

Referring to FIG. 1, FIG. 1 is a schematic diagram of an appearance structure of a conventional keyboard. A plurality of keys 10 and 10' is provided on a surface of the conventional keyboard 1. The keys 10 are classified as keys with common sizes, and the keys 10' are classified as keys with relatively large sizes. Lengths of the keys 10 are slightly greater than widths thereof, and lengths L1 of the keys 10' are far greater than widths W1 thereof. The plurality of keys 10 and 10' is pressed by a user by using fingers, so that a corresponding signal is generated and is sent to a computer, and accordingly, the computer executes functions of the pressed keys. Generally, by pressing the keys 10 and 10', symbols such as English letters, and digits may be entered, or various functions (for example, F1 to F12, or delete) may be executed. The conventional keyboard 1 is a keyboard for use in a notebook computer.

An internal structure of the conventional keyboard is described in the following. Referring to both FIG. 2 and FIG. 3, FIG. 2 is a schematic exploded view of a structure of a conventional keyboard, and FIG. 3 is a schematic structural diagram of a keycap of a conventional keyboard from another viewing angle. The conventional keyboard 1 includes a plurality of keys 10 and 10', a base plate 11, and a thin film switch circuit 12, and a plurality of key switches 121 corresponding to the plurality of keys 10 and 10' is provided on the thin film switch circuit 12. An example of a key 10' with a relatively large width is used for description herein. The key 10' includes a keycap 101, a plurality of scissors-type connecting elements 102, and a rubber elastomer 103. The scissors-type connecting elements 102 are connected to both the keycap 101 and the base plate 11 and each include a first frame 1021 and a second frame 1022. The second frame 1022 is connected to the first frame 1021 by using a shaft, so that the first frame 1021 and the second frame 1022 can swing relative to each other. In addition, the rubber elastomer 103 is disposed between the keycap 101 and the base plate 11.

The base plate 11 includes a plurality of first base plate hooks 111, and the plurality of first base plate hooks 111 may be connected to the first frames 1021 and the second frames 1022. On the other hand, the keycap 101 includes a plurality of first hooks 1011, and the plurality of first hooks 1011 is disposed on an inner surface of the keycap 101 and may be connected to the first frames 1021 and the second frames 1022. Therefore, the keycap 101 is movably fastened on the base plate 11.

When a user presses a keycap 101 of any key 10', the keycap 101 moves downwards relative to the base plate 11, so that first frames 1021 and second frames 1022 of scissors-type connecting elements 102 change from an opened state to a superimposed state, and the keycap 101 moving downwards pushes a rubber elastomer 103. Therefore, the rubber elastomer 103 is abutted and deforms, and triggers a corresponding key switch 121, so that the thin film switch circuit 12 generates a corresponding key signal. When the user no longer presses the keys 10 and 10', the keycap 101 moves upwards relative to the base plate 11 due to an elastic force generated when the rubber elastomer 103 recovers from a deforming state. In this case, the first frames 1021 and the second frames 1022 change from the superimposed state to the opened state, and the keycap 101 recovers to a location at which the keycap 101 is not pressed.

In the conventional keyboard 1, structures of some keys 10' whose lengths L1 are far greater than widths W1 are different from those of keys 10 because the keycaps 101 of the key 10' have relatively large lengths L1. Therefore, in a process in which the user presses the key 10', the keycap 101 thereof easily shakes, affecting operation smoothness of the key 10' and even affecting pressing feelings of the user. Therefore, the key 10' is further provided with a special mechanism to improve the operation smoothness thereof. The key 10' further includes a plurality of balance bars 104, and each of the balance bars 104 includes a connecting rod portion 1041 and two hook portions 1042. The two hook portions 1042 are respectively located at two ends of the balance bar 104.

In addition, the base plate 11 further includes a plurality of second base plate hooks 112, and the second base plate hook 112 includes a plurality of hook holes 1121. Each hook hole 1121 corresponds to one hook portion 1042 and is used for the corresponding hook portion 1042 to penetrate, so that the balance bar 104 is fastened on the base plate 11. On the other hand, the keycap 101 further includes a plurality of second hooks 1012, and the plurality of second hooks 1012 is disposed on the inner surface of the keycap 101 and is arranged in a row. The plurality of second hooks 1012 corresponds to one connecting rod portion 1041, so that the connecting rod portion 1041 is fastened in openings 1013 of the plurality of second hooks 1012. Each opening 1013 has a same width W2, and each opening 1013 has a round shape. The balance bar 104 may be fastened on the keycap 101 and the base plate 11 respectively by using the plurality of second base plate hooks 112 and the plurality of second hooks 1012. By setting the plurality of balance bars 104, the key 10' can be kept balanced so as not to incline in a process of moving upwards or downwards relative to the base plate 11, and the structural strength of the keycap 101 can also be enhanced.

However, in a process of manufacturing the keycap 101, the keycap 101 inevitably has a manufacturing tolerance; therefore, the plurality of openings 1013 of the plurality of second hooks 1012 arranged in a row cannot be accurately located in a same axial direction. Consequently, it is difficult to assemble the balance bar 104 into the plurality of second hooks 1012. Even if the balance bar 104 and the plurality of second hooks 1012 may be barely combined due to elastic materials of the balance bar 104 and the plurality of second hooks 1012, because in a process of pressing the keycap 101, the connecting rod portion 1041 excessively extrudes the plurality of second hooks 1012, the balance bar 104 unsmoothly rotates in the plurality of openings 1013 of the plurality of second hooks 1012, affecting pressing feelings when the user presses the keycap 101. In extreme cases, the second hooks 1012 would even be broken due to rotation of the balance bar 104.

Therefore, a keyboard capable of improving pressing feelings is needed.

SUMMARY OF THE INVENTION

An objective of the present invention is to provide a keyboard capable of improving pressing feelings.

In a preferred embodiment, the present invention provides a keyboard, including a key, a switch circuit board, and a base plate. The key includes a keycap and a balance bar, the keycap is exposed outside the keyboard, and the balance bar is connected to the keycap. The keycap includes a first hook and a second hook. The first hook is disposed on an inner surface of the keycap and is located on an outer side of the keycap. The first hook has a first opening. The second hook is disposed on the inner surface of the keycap and is located in a central area of the keycap. The second hook has a second opening. The balance bar is disposed below the keycap and is fastened in the first opening and the second opening. The switch circuit board is located below the key and is used to be triggered by the key to output a key signal. The base plate is disposed below the switch circuit board, is connected to the balance bar, and is used to carry the key. The first opening has a round shape, and the second opening has an elliptic shape.

In a preferred embodiment, the present invention further provides a keyboard, including a key, a switch circuit board, and a base plate. The key includes a keycap and a balance bar, the keycap is exposed outside the keyboard, and the balance bar is connected to the keycap. The keycap includes a first hook and a second hook. The first hook is disposed on an inner surface of the keycap and is located on an outer side of the keycap. The first hook has a first opening. The second hook is disposed on the inner surface of the keycap and is located in a central area of the keycap. The second hook has a second opening. The balance bar is disposed below the keycap and is fastened in the first opening and the second opening. The switch circuit board is located below the key and is used to be triggered by the key to output a key signal. The base plate is disposed below the switch circuit board, is connected to the balance bar, and is used to carry the key. The width of the first opening is less than the width of the second opening.

In summary, a plurality of first hooks and a plurality of second hooks arranged in a row use opening structures having different shapes or different widths. Even if the plurality of first hooks and the plurality of second hooks cannot be located in a same axial direction due to a manufacturing tolerance of the keycap, the second opening with a relatively large width can still accommodate a connecting rod portion therein. In addition, there are still gaps between the connecting rod portion and the second hooks. Therefore, the connecting rod portion does not extrude the second hooks, and the second hooks would not be extruded and broken. Therefore, in a process in which the keycap is pressed, the balance bar can smoothly rotate without affecting pressing feelings thereof. Compared with a conventional technology, the keyboard of the present invention can indeed improve pressing feelings and can prevent hooks of the keycap from being damaged.

DETAILED DESCRIPTION OF THE PREFERRED EMBODIMENT

Figure 1:
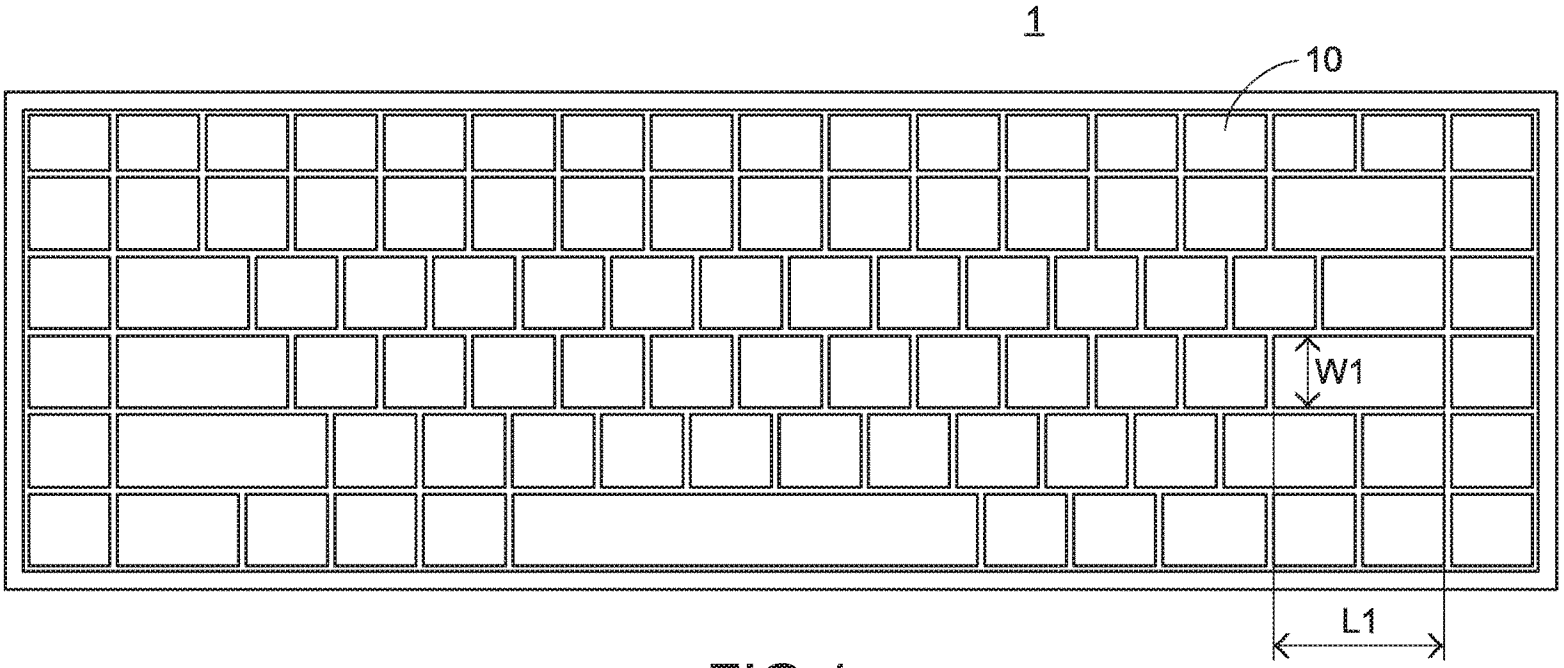
FIG. 1 PRIOR ART
FIG. 1 is a schematic diagram of an appearance structure of a conventional keyboard.
Figure 2:
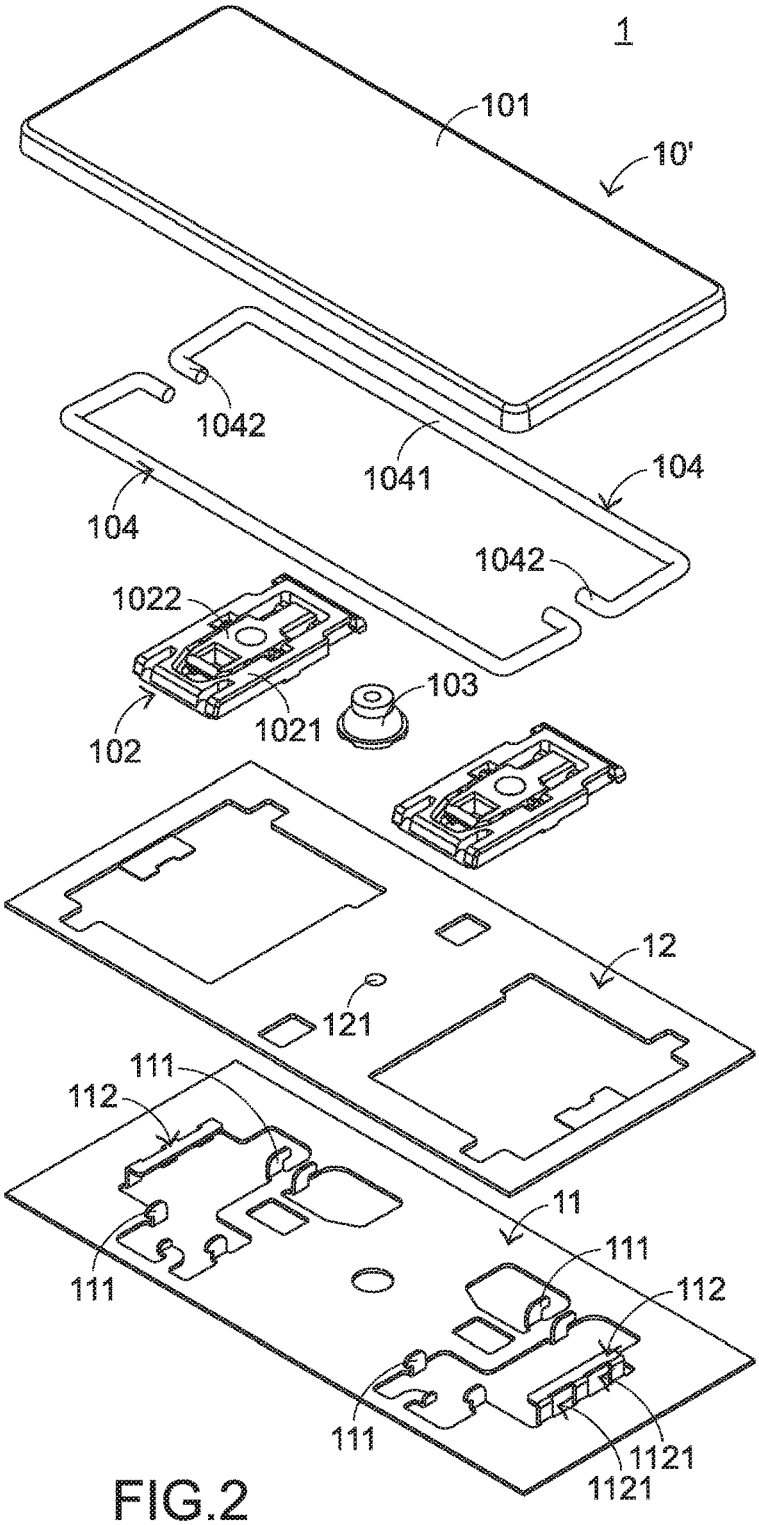
FIG.2 PRIOR ART
FIG. 2 is a schematic exploded view of a structure of a conventional keyboard.
Figure 3:
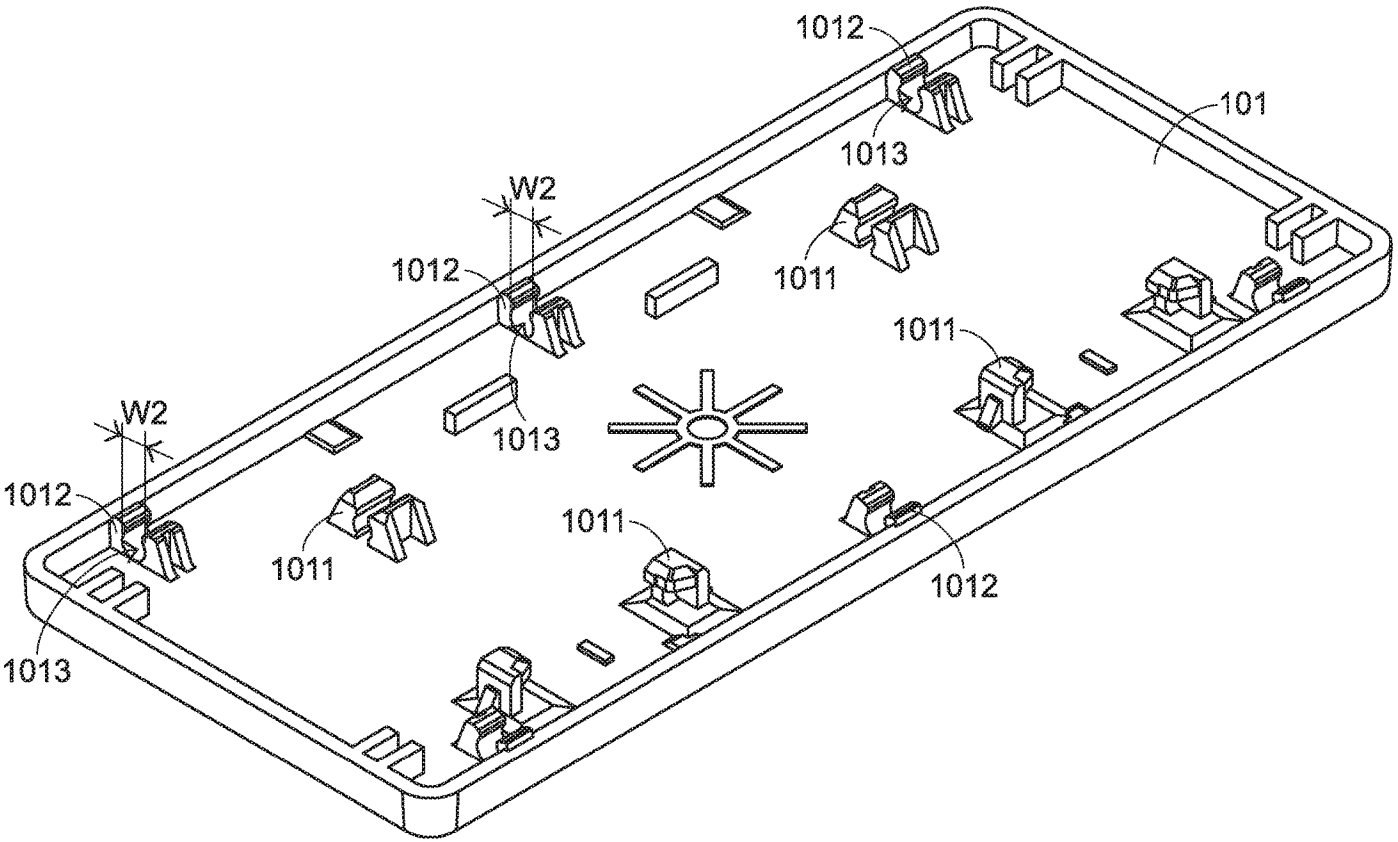
FIG.3 PRIOR ART
FIG. 3 is a schematic structural diagram of a keycap of a conventional keyboard from another viewing angle.
Figure 4:
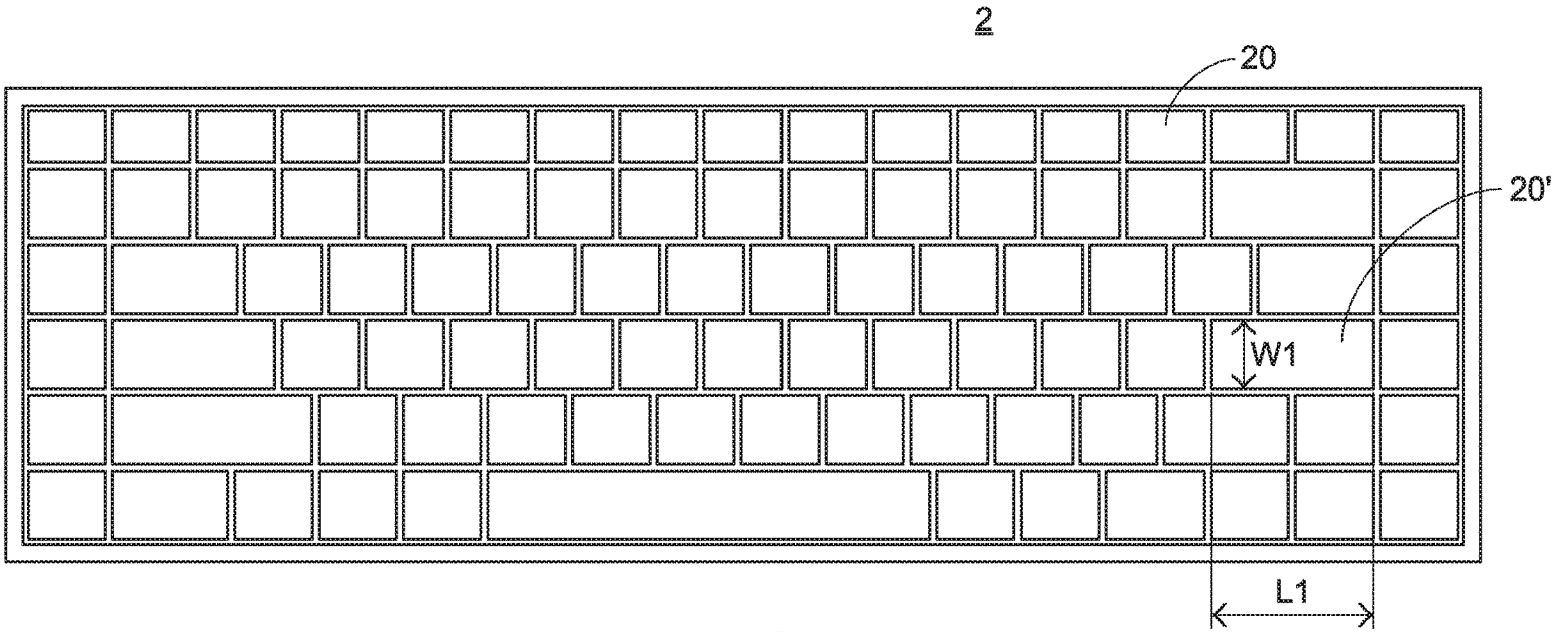
FIG. 4 is a schematic diagram of an appearance structure of a keyboard according to a preferred embodiment of the present invention.

In view of troubles caused by a conventional technology, the present invention provides a keyboard to resolve problems of the conventional technology. First, a structure of the keyboard of the present invention is described. Referring to FIG. 4, FIG. 4 is a schematic diagram of an appearance structure of a keyboard according to a preferred embodiment of the present invention. The keyboard 2 of the present invention includes a plurality of keys 20 and 20', and the plurality of keys 20 and 20' is exposed outside the keyboard 2. These keys 20 and 20' may be pressed by a user by using fingers, so that a corresponding signal is generated and is sent to a computer (not shown in the figure) connected to the keyboard 2, and accordingly, the computer executes functions of the pressed keys. Lengths of the keys 20 are slightly greater than widths thereof, and lengths L1 of the keys 20' are greater than widths W1 thereof.

Figure 5:
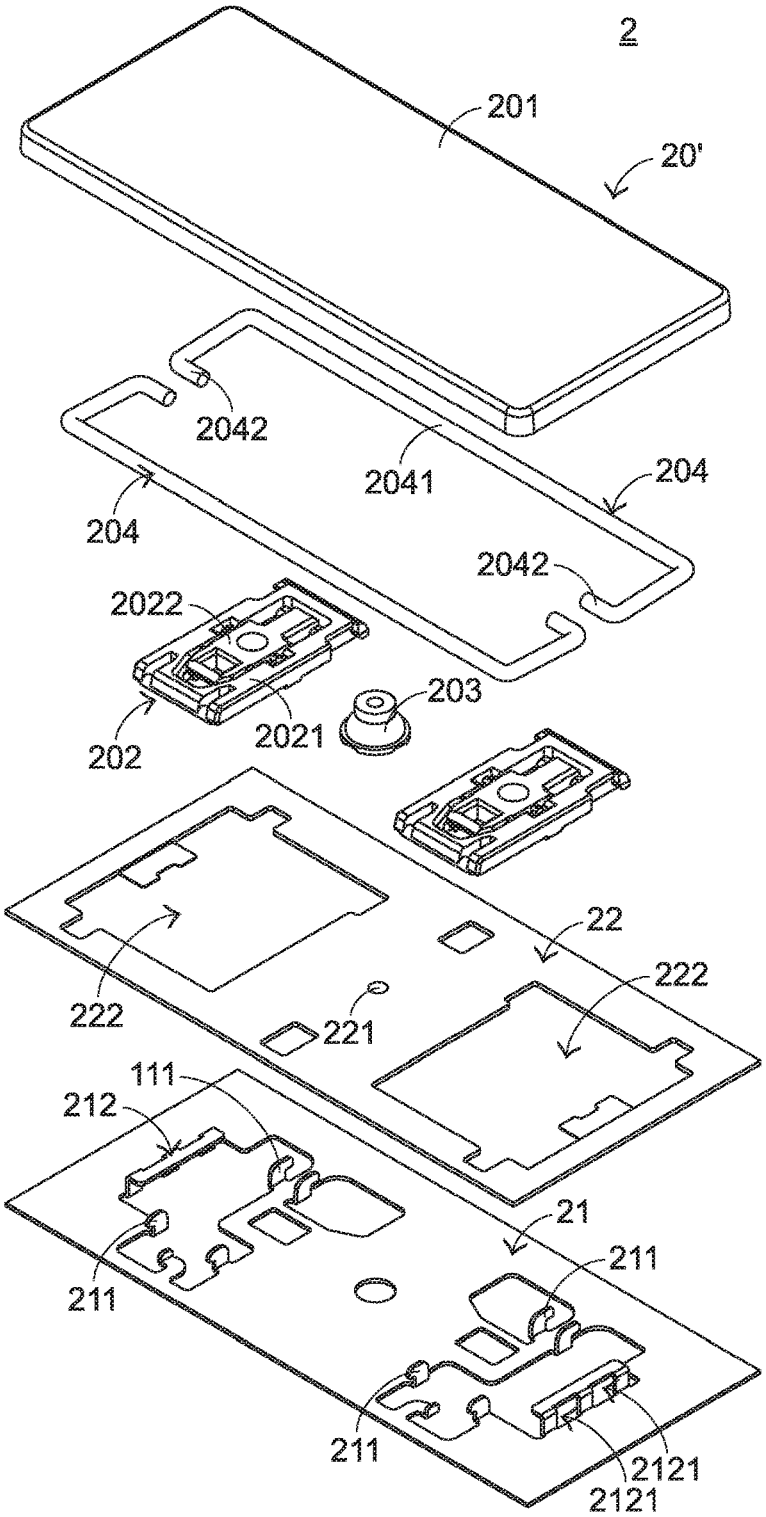
FIG. 5 is a schematic exploded view of a structure of a keyboard according to a preferred embodiment of the present invention.
Figure 6:
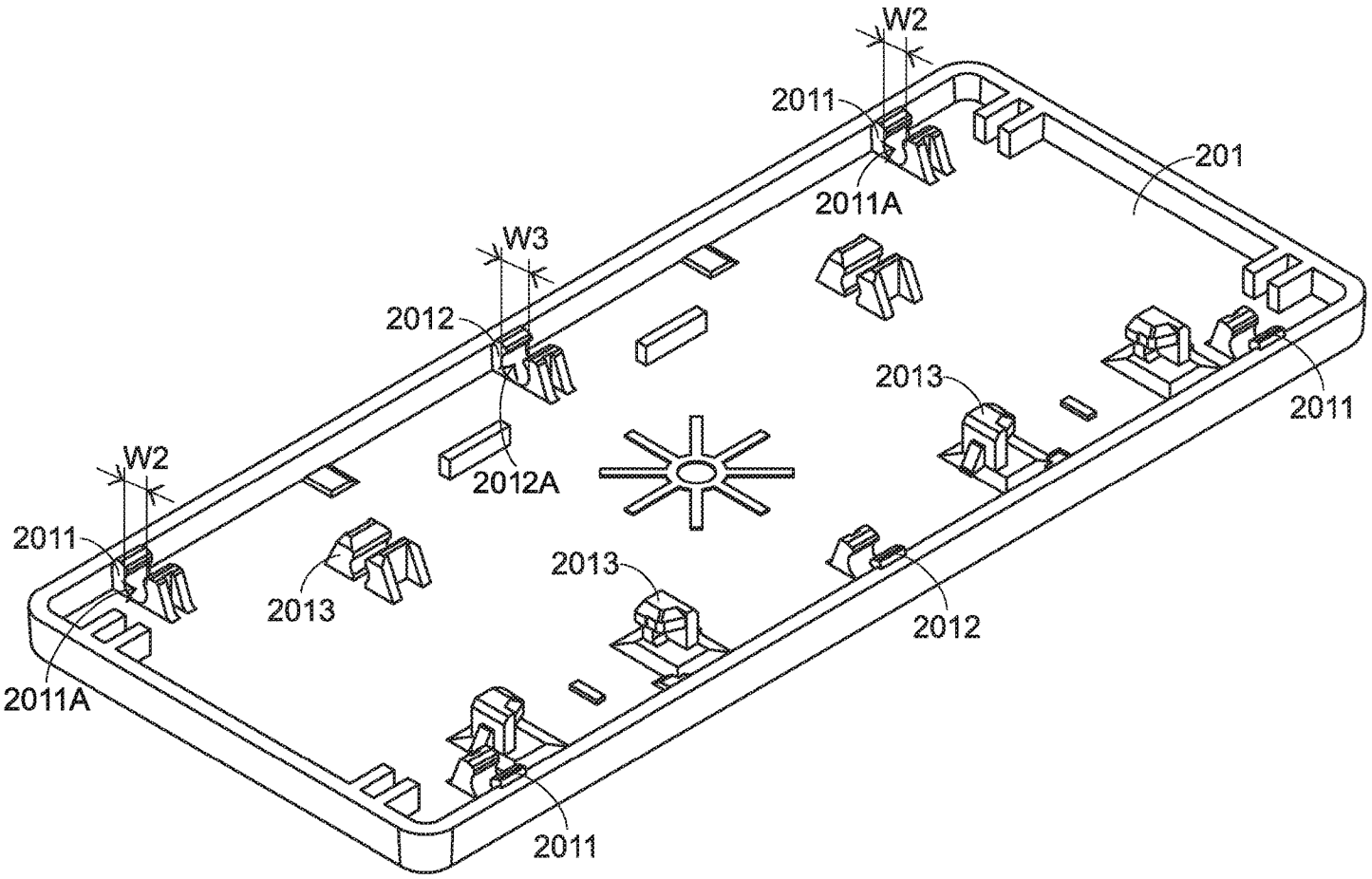
FIG. 6 is a schematic structural diagram of a keycap of a keyboard from another viewing angle according to a preferred embodiment of the present invention.

An internal structure of the keyboard 2 of the present invention is described in the following. Referring to both FIG. 5 and FIG. 6, FIG. 5 is a schematic exploded view of a structure of a keyboard according to a preferred embodiment of the present invention, and FIG. 6 is a schematic structural diagram of a keycap of a keyboard from another viewing angle according to a preferred embodiment of the present invention. Structures of the keys 20' are used as an example for description in FIG. 5 and FIG. 6. The keyboard 2 of the present invention further includes a base plate 21 and a switch circuit board 22 in addition to the plurality of keys 20'. The base plate 21 is disposed below the plurality of keys 20' and may be connected to the plurality of keys 20'. The base plate 21 includes a plurality of first base plate hooks 211 and a plurality of second base plate hooks 212. The first base plate hooks 211 and the second base plate hooks 212 all function to be connected to the plurality of keys 20'. Each second base plate hook 212 includes a plurality of hook holes 2121. In this preferred embodiment, the base plate 21 is made of a metal material.

Each key 20' includes a keycap 201, a plurality of scissors-type connecting elements 202, an elastic element 203, and a plurality of balance bars 204. The keycap 201 is exposed outside the keyboard 2. The scissors-type connecting elements 202 are connected to the corresponding keycap 201 and the first base plate hooks 211 of the base plate 21, to fasten the keycap 201 on the base plate 21, and make the keycap 201 move relative to the base plate 21. The elastic element 203 is located between the corresponding keycap 201 and the switch circuit board 22 and corresponds to a key switch 221 of the switch circuit board 22. The elastic element 203 functions to be pushed by the corresponding keycap 201 to abut against the corresponding key switch 221. In this preferred embodiment, the elastic element 203 is a rubber elastomer, and the scissors-type connecting elements 202 are made of a plastic material.

The switch circuit board 22 is located below the keys 20', and functions to be triggered by the keys 20' to output a corresponding key signal. The switch circuit board 22 includes a plurality of circuit board openings 222 corresponding to the plurality of scissors-type connecting elements 202, so that the plurality of scissors-type connecting elements 202 can be connected to the plurality of first base plate hooks 211. In this preferred embodiment, the switch circuit board 22 is a thin film switch circuit, and an internal structure and an operation principle thereof are well known to a person skilled in the art and therefore are not described in detail.

Structures of the balance bar 204 of the key 20' and the corresponding keycap 201 are described in the following. The balance bar 204 is connected to the keycap 201 and the base plate 21. Each of the balance bars 204 includes a connecting rod portion 2041 and two hook portions 2042. The connecting rod portion 2041 may be connected to the keycap 201, and the two hook portions 2042 are respectively located at two ends of the connecting rod portion 2041. Each hook portion 2042 corresponds to one hook hole 2121 and may penetrate the hook hole 2121 to fasten the balance bar 204 on the base plate 21. On the other hand, the keycap 201 includes a plurality of first hooks 2011, a plurality of second hooks 2012, and a plurality of third hooks 2013. The plurality of third hooks 2013 is disposed on an inner surface of the keycap 201 and may be connected to corresponding scissors-type connecting elements 202. The plurality of first hooks 2011 and the plurality of second hooks 2012 are also disposed on the inner surface of the keycap 201 and function to be connected to the connecting rod portions 2041.

It should be noted that the plurality of first hooks 2011 is disposed on an outer side of the keycap 201, and the second hooks 2012 are disposed in a central area of the keycap 201, that is, are disposed between the plurality of first hooks 2011, and are arranged in a same row with the plurality of first hooks 2011. Each first hook 2011 has a first opening 2011A, and the first opening 2011A has a round shape. The second hook 2012 has a second opening 2012A, and the second opening 2012A has an elliptic shape. The width W2 of the first opening 2011A is less than the width W3 of the second opening 2012A.

It can be learned according to the foregoing descriptions that the plurality of first hooks and the plurality of second hooks arranged in a row use opening structures having different shapes or different widths. Even if the plurality of first hooks and the plurality of second hooks cannot be located in a same axial direction due to a manufacturing tolerance of the keycap, the second opening with a relatively large width can still accommodate the connecting rod portion therein. In addition, there are still gaps between the connecting rod portion and the second hooks. Therefore, the connecting rod portion does not extrude the second hooks, and the second hooks would not be extruded and broken. Therefore, in a process in which the keycap is pressed, the balance bar can smoothly rotate without affecting pressing feelings thereof. Compared with a conventional technology, the keyboard of the present invention can indeed improve pressing feelings and can prevent hooks of the keycap from being damaged.

The foregoing descriptions are merely preferred embodiments of the present invention and are not used to limit the claims of the present invention. Therefore, other equivalent changes or modifications accomplished without departing from the spirit disclosed in the present invention shall all fall within the claims of this application.

What is claimed is:

1. A keyboard, comprising: a key, comprising: a keycap, exposed outside the keyboard and comprising: a first hook, disposed on an inner surface of the keycap and located on an outer side of the keycap, wherein the first hook has a first opening; and a second hook, disposed on the inner surface of the keycap and located in a central area of the keycap, wherein the second hook has a second opening; and a balance bar, disposed below the keycap and fastened in the first opening and the second opening; a switch circuit board, located below the key and used to be triggered by the key to output a key signal; and a base plate, disposed below the switch circuit board, connected to the balance bar, and used to carry the key, wherein the first opening has a round shape, and the second opening has an elliptic shape; wherein a width of the first opening is less than a width of the second opening, so that the balance bar is fastened in the first opening and the second opening.

2. The keyboard according to claim 1, wherein the base plate has a hook hole, and the balance bar comprises:

a connecting rod portion, fastened in the first opening and the second opening to be connected to the keycap; and a hook portion, located at an end of the connecting rod portion and corresponding to the hook hole, wherein the hook portion penetrates the hook hole, so that the balance bar is fastened on the base plate.

3. The keyboard according to claim 2, wherein the connecting rod portion and the hook portion are integrally formed with the balance bar, and all are made of a metal material or a plastic material.

4. The keyboard according to claim 1, wherein the key further comprises:

a scissors-type connecting element, connected to the keycap and the base plate and used to: fasten the keycap on the base plate and make the keycap move relative to the base plate; and an elastic element, located between the keycap and the switch circuit board, corresponding to the key switch, and used to be pushed by the keycap to abut against the switch circuit board, wherein the elastic element applies an elastic force to the keycap when the elastic element is no longer pushed by the keycap.

5. A keyboard, comprising:

a key, comprising:

a keycap, exposed outside the keyboard and comprising:

a first hook, disposed on an inner surface of the keycap and located on an outer side of the keycap, wherein the first hook has a first opening; and a second hook, disposed on the inner surface of the keycap and located in a central area of the keycap, wherein the second hook has a second opening; and a balance bar, disposed below the keycap and fastened in the first opening and the second opening;

a switch circuit board, located below the key and used to be triggered by the key to output a key signal; and a base plate, disposed below the switch circuit board, connected to the balance bar, and used to carry the key, wherein a width of the first opening is less than a width of the second opening.

6. The keyboard according to claim 5, wherein the first opening has a round shape, and the second opening has an elliptic shape, so that the balance bar is fastened in the first opening and the second opening.

7. The keyboard according to claim 5, wherein the base plate has a hook hole, and the balance bar comprises:

a connecting rod portion, fastened in the first opening and the second opening to be connected to the keycap; and a hook portion, located at an end of the connecting rod portion and corresponding to the hook hole, wherein the hook portion penetrates the hook hole, so that the balance bar is fastened on the base plate.

8. The keyboard according to claim 7, wherein the connecting rod portion and the hook portion are integrally formed with the balance bar, and all are made of a metal material or a plastic material.

9. The keyboard according to claim 5, wherein the key further comprises:

a scissors-type connecting element, connected to the keycap and the base plate and used to fasten the keycap on the base plate and make the keycap move relative to the base plate; and an elastic element, located between the keycap and the switch circuit board, corresponding to the key switch, and used to be pushed by the keycap to abut against the switch circuit board, wherein the elastic element applies an elastic force to the keycap when the elastic element is no longer pushed by the keycap.

* * * * *